US005266038A

United States Patent [19]

Nakamura

[11] Patent Number: 5,266,038

[45] Date of Patent: Nov. 30, 1993

[54] ELECTRICAL CONNECTOR

[75] Inventor: Masahiko Nakamura, Yao, Japan

[73] Assignee: Hosiden Corporation, Yao, Japan

[21] Appl. No.: 883,571

[22] Filed: May 15, 1992

[30] Foreign Application Priority Data

Jun. 26, 1991 [JP] Japan ..... 3-48544[U]

[51] Int. Cl.[5] ..... H01R 9/09

[52] U.S. Cl. ..... 439/79; 439/83; 439/607

[58] Field of Search ..... 439/79-83, 439/607, 609

[56] References Cited

U.S. PATENT DOCUMENTS 4,687,267 8/1987 Header et al. ..... 439/607

5,017,156 5/1991 Sugiyama ..... 439/607

*Primary Examiner*—Paula A. Bradley

*Attorney, Agent, or Firm*—Jones, Tullar & Cooper

[57] ABSTRACT

An electrical connector of the vertical type suitable for high-speed transmission including a hollow body member, the transverse width of which is shorter than its vertical thickness, a contact piece holding portion projecting from the body member, the transverse width of which is shorter than its vertical thickness, a plurality of contact piece engagement grooves formed in the thickness direction of the lateral sides of the contact piece holding portion, a plurality of concave holes formed in the contact piece holding portion, a plurality of through-holes formed in the front wall of the body member, and a plurality of contact-piece members formed by punching as a unitary structure. Each contact piece member has a stepped engagement portion and a pawl. The stepped engagement portion contacting the inner surface of the front wall of the body member, and the pawls contacting the outer surface of the front wall of the body member.

6 Claims, 10 Drawing Sheets

ELECTRICAL CONNECTOR

Background of the Invention

1. Field of the Invention

The present invention relates to an electrical connector, and more particularly to an electrical connector having contact-piece members of which contact-piece portions having contact areas, intermediate arcuate portions and terminal, portions are integrally formed as punched out portions, the intermediate arcuate portions not being formed by bending a material in the thickness direction thereof. Such an electrical connector is adapted to be used as a plug.

2. Description of the Prior Art

As an electrical connector of the type mentioned above, there is known an electrical connector shown in FIG. 10. In FIG. 10, the electrical connector has a main body 100 having a hollow body member 110 and a contact piece holding portion 120 projecting from the front wall 111 of the body member 110. The contact piece holding portion 120 is provided in the top and bottom surfaces thereof in the vertical direction t2 thereof with contact piece engagement grooves 121, 122, respectively. The contact piece holding portion 120 is also provided with concave holes 123, 124 extending forwardly from the tips of the contact piece engagement grooves 121, 122. The front wall 111 has through-holes 112, 113 which communicate with the contact piece engagement grooves 121, 122, respectively. In the main body 100 having the arrangement mentioned above, there are assembled two types of contact-piece members 200, 300 opposite to each other in the vertical direction t2 of the contact piece holding portion 120.

In one contact-piece member 200, a contact-piece portion 210 having a contact area is fitted and inserted into the through-hole 112, to the contact piece engagement groove 121, an intermediate arcuate portion 230 extends rearwardly from the contactpiece portion 210 and is disposed inside of the body member 110, and a terminal portion 240 extending from the intermediate arcuate portion 230 projects to the outside of the body member 110. As clearly shown in FIG. 10, the other contact-piece member 300 has an arrangement similar to that of the contact-piece member 200 and is assembled with the main body 100.

The electrical connector in FIG. 10 is of the horizontal type in which a plurality of pairs of the contact-piece members 200, 300 are disposed in the transverse direction of the contact piece holding portion 120 (in the direction at a right angle to the paper plane in FIG. 10). In other words, the thickness direction t1 of each of the contact-piece portions 210, 310 is identical with the vertical direction t2 of each of the body member 110 and the contact piece holding portion 120.

In such an electrical connector of the horizontal type, the contact-piece member 200 is generally secured to the main body 100 in the following arrangement.

A projecting piece 220 which projects from the front end of the contact-piece portion 210, is fitted into and held by the concave hole 123, and a pawl 211 formed on the contact-piece portion 210 as cut-raised therefrom, is engaged with the outer surface of the front wall 111 of the body member 110. A bent portion 231 of the intermediate portion 230 which is bent with respect to the contact-piece portion 210, is engaged with a stepped portion 114 at a terminal end of a groove communicating with the through-hole 112. A predetermined part of the intermediate arcuate portion 230 is pressingly inserted into a groove 232 formed in the body member 110 correspondingly to each contact-piece member 200.

The other contact-piece member 300 has an arrangement similar to that mentioned above. The other contact-piece member 300 has a contact-piece portion 310, a projecting piece 320, an intermediate bent portion 330, a terminal portion 340 and a pawl 311.

A shield frame 400 has a grounding terminal 410. There is formed a groove 332 into which the intermediate bent portion 330 of the other contact-piece member 300 is pressingly inserted.

On the other hand, there has recently been proposed an electrical connector of the vertical type, in which: the contact-piece members are formed such that the surfaces of the contact-piece portions are vertical, unlike an electrical connector of the horizontal type in which the surfaces of the contact-piece portions are horizontal; and (ii) in which a plurality of such contact-piece members are arranged in the vertical direction of the body member and the contact piece holding portion. In such an electrical connector of the vertical type, two contact-piece members of a pair can be respectively disposed at both transverse sides of the contact piece holding portion in a transversely symmetrical manner, thus facilitating balancing of the contact-piece members with each other in view of the configuration. This is considered advantageous for high speed data transmission.

However, when making an electrical connector of the vertical type in a compact design, there are instances where the fixing structure used in the electrical connector of the horizontal type of FIG. 10 cannot be applied as it is. More specifically, in a small-size electrical connector of the vertical type, it is required to make two contact-piece members (of a pair to be symmetrically disposed at both transverse sides of the contact piece holding portion) different from each other in shape. Accordingly, these contactpiece members cannot be symmetrically disposed in a balanced manner inside of the body member. This is considered disadvantageous in high-speed transmission.

SUMMARY OF THE INVENTION

The present invention is proposed in view of the foregoing.

It is an object of the present invention to provide an electrical connector of the vertical type suitable for high-speed transmission, in which the contact-piece members are fixed to the body member in a novel structure.

It is another object of the present invention to provide an electrical connector in which the contact-piece members can be readily assembled with the body member.

It is a further object of the present invention to provide an electrical connector in which a shield frame surrounding the body member and a contact piece holding portion is hardly permanently deformed even though the electrical connector is frequently inserted into and removed from a counter electrical connector.

To achieve the objects mentioned above, the electrical connector in accordance with an embodiment of the present invention comprises:

a hollow body member having a front wall, a top wall, a bottom wall and lateral walls, the transverse width size of the hollow body member being shorter than the vertical thickness size thereof;

a contact piece holding portion projecting forwardly from the front wall of the body member, the transverse width size of the contact piece holding portion being shorter than the vertical thickness size thereof;

a plurality of contact piece engagement grooves formed in a plurality of parts in the thickness direction of the lateral sides of the contact piece holding portion;

a plurality of concave holes formed in the contact piece holding portion, the concave holes forwardly extending from the tips of the contact piece engagement grooves, respectively;

a plurality of through-holes formed in the front wall of the body member, the through-holes communicating with the contact piece engagement grooves;

contact-piece members so formed by punching as to have, in a unitary structure, (i) contacts formed at predetermined positions thereof and adapted to contact a counter electrical connector, (ii) contact-piece portions passed through the throughholes and engaged with the contact piece engagement grooves in the contact piece holding portion, (iii) projecting pieces which project from the front ends of the contact-piece portions and which are fitted in and held by the concave holes in the contact piece holding portion, (iv) intermediate arcuate portions extending rearwardly from the contact-piece portions and disposed inside of the body member, and (v) terminal portions extending from the intermediate arcuate portions;

stepped engagement portions formed by bending the boundary parts between the contact-piece portions and the intermediate arcuate portions, the stepped engagement portions coming in contact with the inner surface of the front wall of the body member; and pawls so formed at the contact-piece portions as to face the stepped engagement portions, the pawls being engaged with the outer surface of the front wall of the body member.

In the electrical connector having the arrangement mentioned above, the projecting pieces of the contact-piece members are fitted in and held by the concave holes in the contact piece holding portions, and the base end portions of the contact-piece portions of the contact-piece members are inserted into the through-holes in the front wall of the body member. This prevents the contact-piece portions from being separated from the contact piece holding portion. Further, the engagement portions of the contact-piece members come in contact with the inner surface of the front wall of the body member. This prevents the contact-piece portions from being forcibly forwardly pushed and buckled. Further, the pawls of the contact-piece members are engaged with the outer surface of the front wall of the body member. This prevents the contact-piece portions from being pulled out from the through-holes. In the electrical connector or having the arrangement mentioned above, the contact-piece members can be securely fixed to the main body even though the electrical connector is of the vertical type. Further, it is possible to securely prevent not only the contact-piece portions from being raised and buckled, but also the contact-piece members from being pulled out. Still further, with both lateral sides of the contact piece holding portion utilized, the contact-piece members are oppositely disposed. Accordingly, the opposite contact-piece members can be readily disposed in a symmetrical manner so that the contact-piece members can be balanced in view of the configuration. Thus, there can be provided an electrical connector suitable for high-speed transmission.

In the electrical connector according to another embodiment of the present invention, the body member is provided in the bottom wall portion thereof with notch-like grooves formed throughout the thickness of the bottom wall portion, the notch-like grooves extending forwardly from the rear end of the body member, engagement grooves are formed in a plurality of parts in the thickness direction of the wall surfaces of the notch-like grooves, the engagement grooves extending forwardly from the rear end of the body member, the terminal portions extend from the intermediate arcuate portions of the contact-piece members, the intermediate arcuate portions having arcuate areas which are formed by punching and not formed by bending, and the terminal portions have projections which are inserted into the engagement grooves in the forward direction thereof such that the vertical movements of the projections are regulated by the upper and lower stepped parts of the engagement grooves and that the forward movement of the projections is regulated by the stepped parts at the front ends of the engagement grooves.

In the electrical connector having the arrangement mentioned above, the projections of the terminal portions are positionally regulated by the upper, lower and front stepped parts of the engagement grooves, thus preventing the terminal portions from being vertically and forwardly moved. Further, when the contact-piece portions of the contact-piece members are passed through the through-holes in the front wall of the body member and engaged with the engagement grooves of the contact piece holding portion, the projections are fitted into the engagement grooves. In the electrical connector having the arrangement mentioned above the contact-piece portions and the terminal portions of the contact-piece members extend in different directions, respectively, through the arcuate areas of the intermediate arcuate portions. However, the intermediate arcuate portions of the contact-piece members are formed by punching and not by bending, and the projections of the terminal portions extending from the intermediate arcuate portions are engaged with the engagement grooves to prevent the terminal portions from being vertically and forwardly moved. Accordingly, the arcuate areas of the intermediate arcuate portions are hardly buckled even though a load is forcibly applied to the terminal portions or the like at the time, for example, when the electrical connector is mounted on a circuit board.

The electrical connector according to a further embodiment of the present invention further comprises a shield frame having a U-shaped portion, a casing portion and a cover portion, the casing portion and the cover portion being disposed at both sides of the U-shaped portion, the U-shaped portion being placed on the body member, the casing portion surrounding the contact piece holding portion, and the cover portion overlapping the rear surface of the body member to close the rear surface.

In the electrical connector having the arrangement mentioned above, the shield frame made of a single metallic plate covers the entire contact-piece members held by the main body. This assures reliable shielding properties which are advantageous in transmission at a higher speed.

Other features and effects of the present invention will be apparent from the following description with reference to the attached drawings illustrating embodiments thereof.

DETAILED DESCRIPTION OF THE PREFERRED EMBODIMENT

Figure 1:
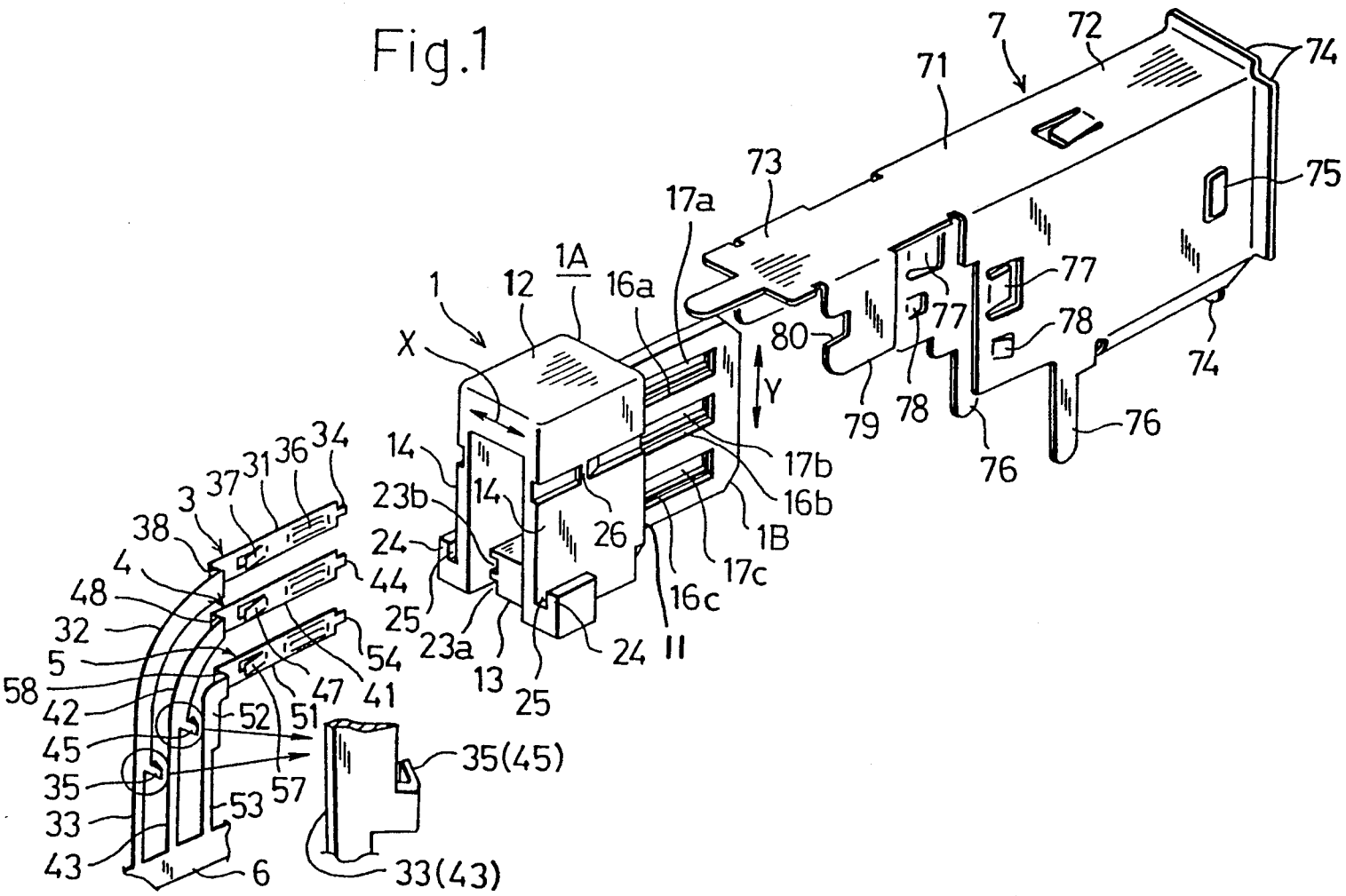
FIG. 1 is an exploded perspective view of the electrical connector according to an embodiment of the present invention.
Figure 4:
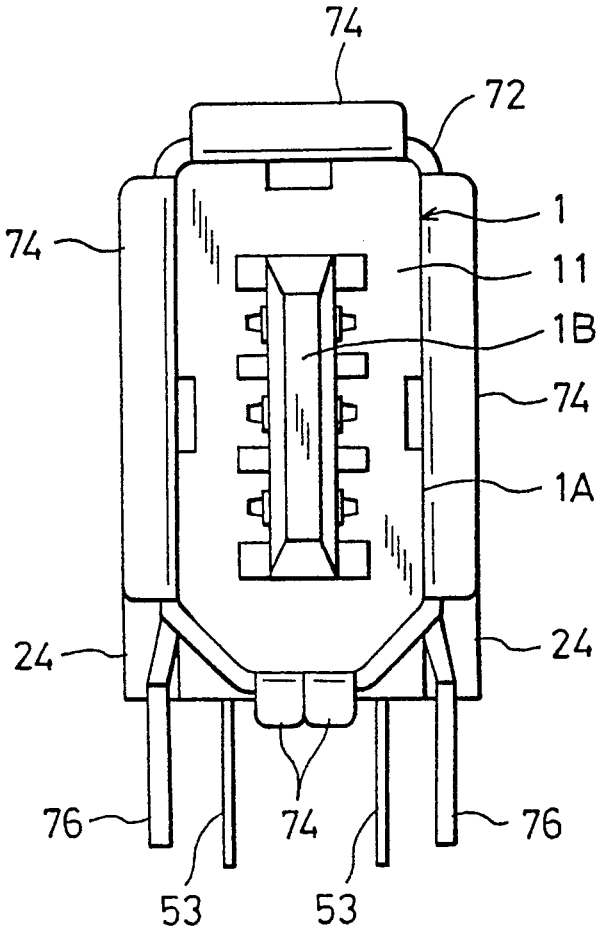
FIG. 4 is a front view of the electrical connector shown in FIG. 1.

FIG. 1 shows the electrical connector of the present invention having a main body 1 which comprises (i) a hollow body member 1A having a front wall 11, a top wall 12, a bottom wall portion 13 and lateral side walls 14; and (ii) a contact piece holding portion 1B which forwardly projects from the front wall 11 of the body member 1A. The body member 1A and the contact piece holding portion 1B are integrally molded from synthetic resin which is an insulator. In each of the body member 1A and the contact piece holding portion 1B, the width in the transverse direction X is smaller than the thickness in the vertical direction Y. As shown in FIG. 4, the contact piece holding portion 1B projects from the center part of the front wall 11 of the body member 1A.

Figure 2:
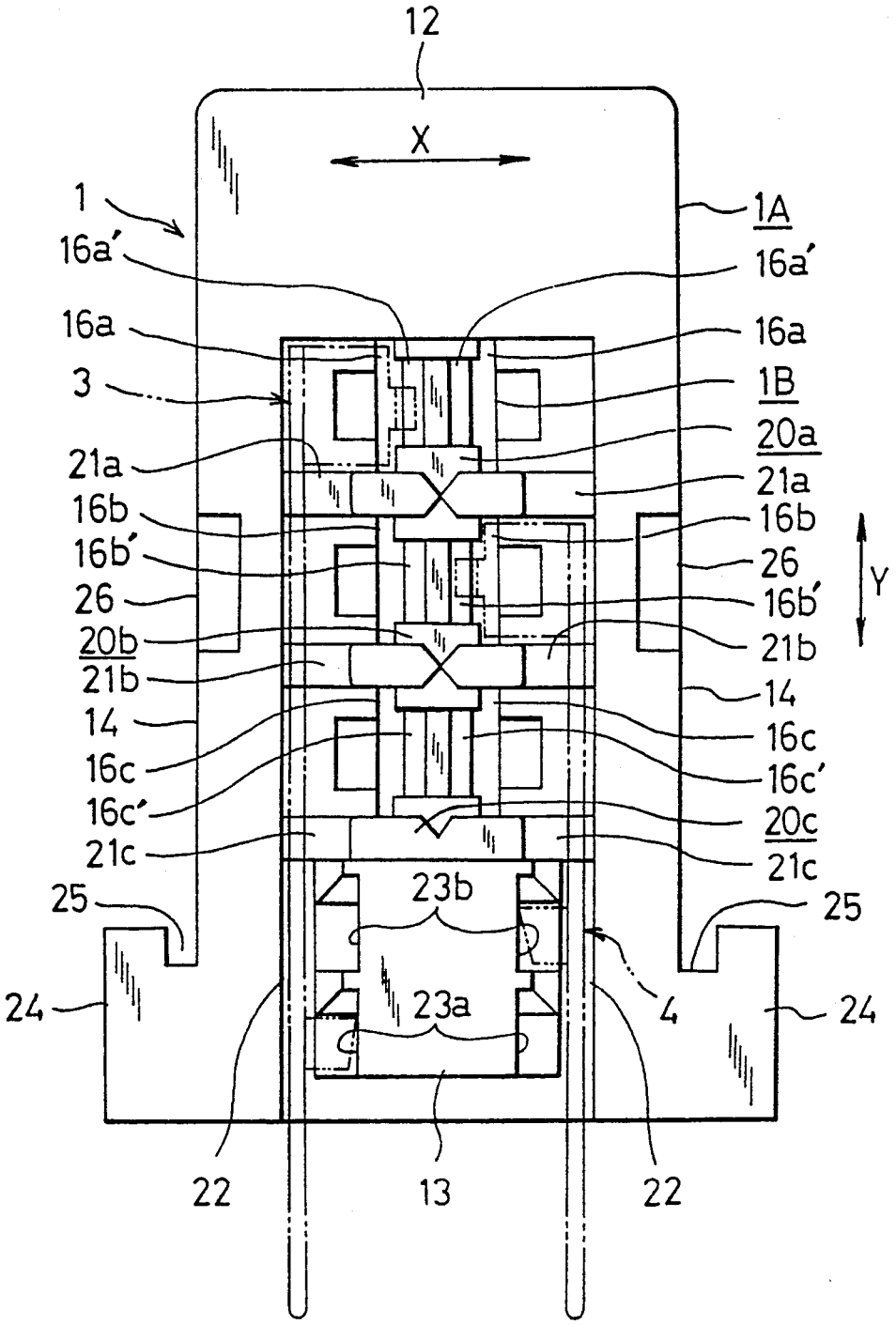
FIG. 2 is a rear view of a main body of the electrical connector shown in FIG. 1.

As shown in FIG. 2, the contact piece holding portion 1B is provided in each of the lateral sides in the transverse direction X with three contact piece engagement grooves 16*a*, 16*b*, 16*c* in parallel with one another at regular spatial intervals. Concave holes 16*a*', 16*b*', 16*c*' are formed and extend forwardly from the tips of the contact piece engagement grooves 16*a*, 16*b*, 16*c*, respectively. As clearly shown in FIG. 1, openings 17*a*, 17*b*, 17*c* are formed at other parts than the upper and lower parts of the contact piece engagement grooves 16*a*, 16*b*, 16*c*.

Figure 7:
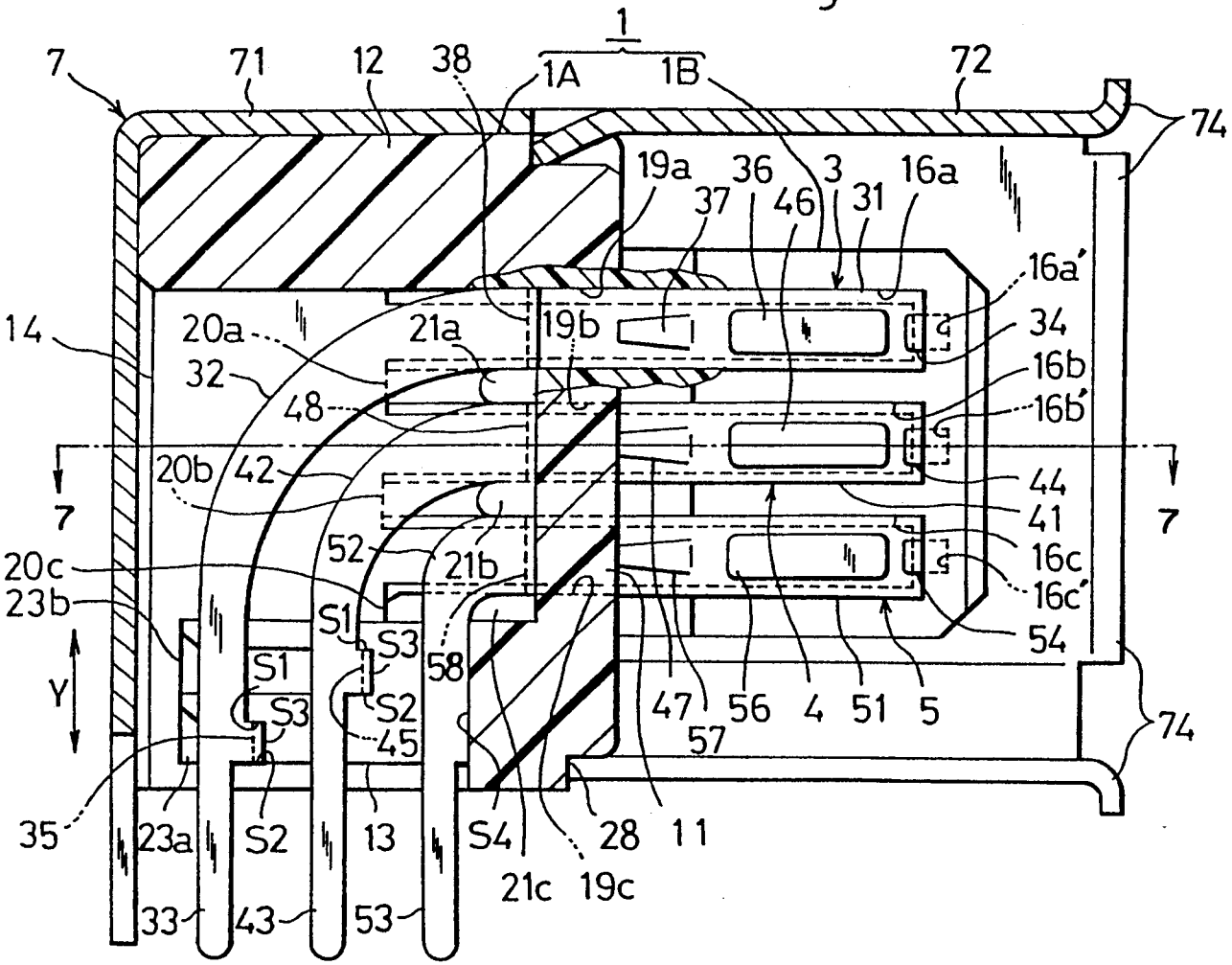
FIG. 7 is a vertical section view in side elevation of the electrical connector shown in FIG. 1.
Figure 8:
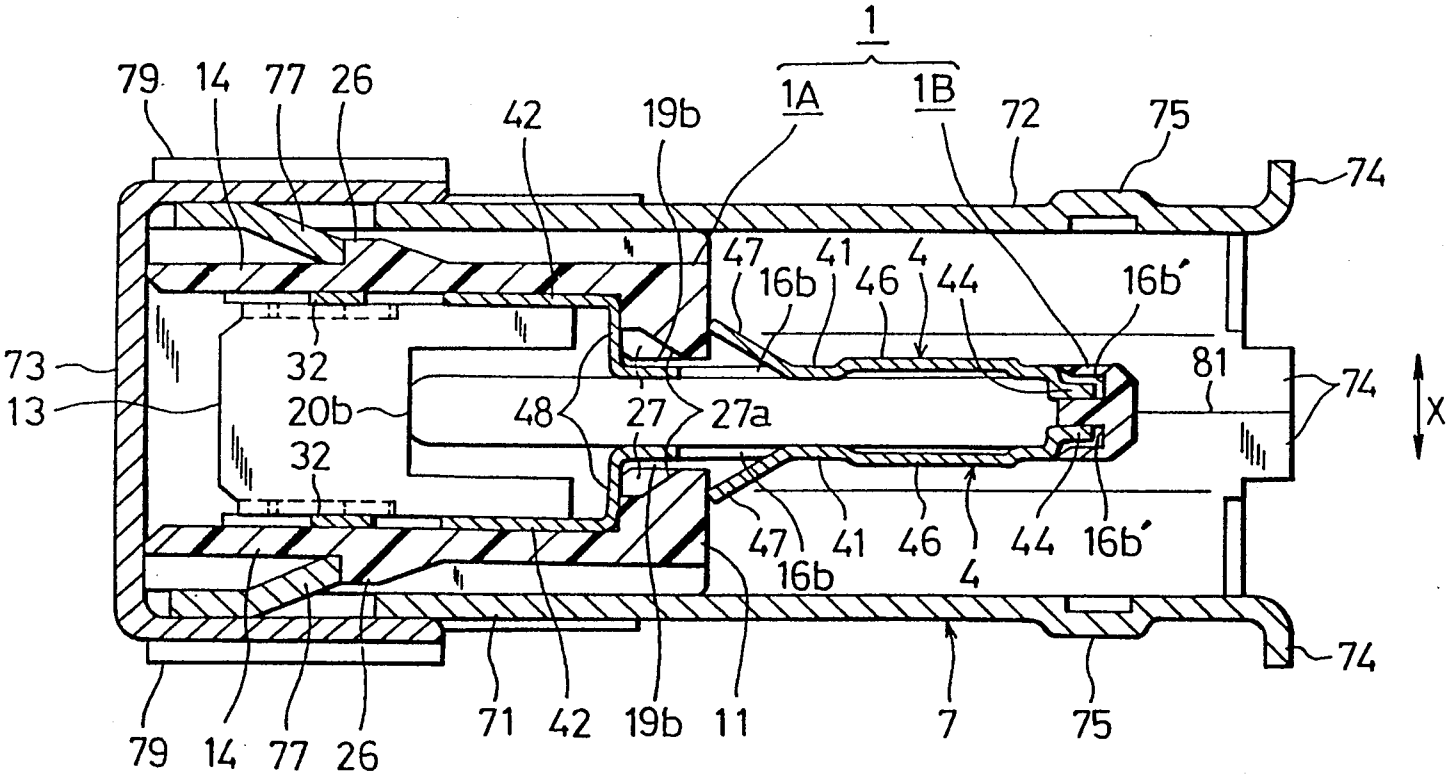
FIG. 8 is a section view taken along the line 7—7 in FIG. 7.

As shown in FIGS. 7 or 8, the body member 1A is provided in each of two parts in the transverse direction X of the front wall 11 with through-holes 19*a*, 19*b*, 19*c* which communicate with the contact piece engagement grooves 16*a*, 16*b*, 16*c*, respectively. Three projecting portions 20*a*, 20*b*, 20*c* extend rearwardly from three parts of the inner surface of the front wall 11. Convex portions 21*a*, 21*b*, 21*c* are formed between the projecting portions 20*a*, 20*b*, 20*c* and the lateral side walls 14, the convex portions 21*a*, 21*b*, 21*c* being shorter than the projecting portions 20*a*, 20*b*, 20*c*. As shown in FIG. 7, the rear end surface of the bottom wall portion 13 of the body member 1A is located in a position slightly forward with respect to the rear end of the body member 1A. As shown in FIG. 2, the bottom wall portion 13 is provided on both sides thereof in the transverse direction X with notch-like grooves 22 formed throughout the thickness of the bottom wall portion 13, the notch-like grooves 22 extend forwardly from the rear end of the body member 1A. As shown in FIGS. 2 and 7, each of the notch-like grooves 22 is provided, in two parts in the vertical direction Y of the groove wall thereof at the side of the bottom wall portion 13, with engagement grooves 23*a*, 23*b* extending forwardly from the rear end of the body member 1A. The upper engagement groove 23*b* extends forwardly more than the lower engagement groove 23*a*. As shown in FIG. 2, the body member 1A is provided at the lower portions of the rear ends of the lateral side walls 14 thereof with projecting portions 24 having concave grooves 25. As shown in FIGS. 1 and 8, the body member 1A is provided on the lateral side walls 14 with engagement portions 26.

Assembled with the main body 1 are two sets of first, second and third contact-piece members 3, 4, 5 which are disposed symmetrically in a well-balanced manner. FIG. 1 shows only one set of the contact-piece members 3, 4, 5.

The first contact-piece member 3 is a punchedmolded body having, in a unitary structure, a contact-piece portion 31, an intermediate arcuate portion 32, a terminal portion 33, a projecting piece 34 and a projection 35. The contact-piece portion 31 has (i) a contact area 36 serving as a contact for a counter electrical connector (not shown); and (ii) a pawl 37 formed, as outwardly cut-raised, at a rearward part with respect to the contact area 36. The intermediate arcuate portion 32 is, in its entirety, an arcuate area which is formed at the time when the first contact-piece member 3 is punched. That is, the intermediate arcuate portion 32 is not formed by bending a material. The boundary part between the intermediate arcuate portion 32 and the contact-piece portion 31 is bent at two positions thereof at a right angle, thus forming a stepped engagement portion 38. The stepped engagement portion 38 faces the pawl 37. The terminal portion 33 is connected to the contact-piece portion 31 through the intermediate arcuate portion 32 and extends at a right angle to the contact-piece portion 31. As shown in FIG. 1 in an enlarged manner, the projection 35 is formed as bent inwardly of the terminal portion 33. The projecting piece 34 projects forwardly from the contact-piece portion 31 at its position slightly shifted to the inside.

The second contact-piece member 4 has elements similar to those of the first contact-piece member 3. In the second contact-piece member 4, however, the radius of the arcuate area throughout the intermediate arcuate portion 42 is smaller than that of the first contact-piece member 3, and the projection 45 is located in a position higher than that in which the projection 35 of the first contact-piece member 3 is located. The second contact-piece member 4 has a contact-piece portion 41, a terminal portion 43, a projecting piece 44, a contact area 46, a pawl 47 and a stepped engagement portion 48.

The third contact-piece member 5 has elements similar to those of each of the first and second contact-piece members 3, 4, such as: (i) a contact-piece portion 51 including a contact area 56 and a pawl 57; (ii) an intermediate arcuate portion 52; (iii) a stepped engagement portion 58 formed by bending a boundary part between the contact-piece portion 51 and the intermediate arcuate portion 52; (iv) a terminal portion 53; and (v) a projecting piece 54. In the third contact-piece member 5, however, the radius of the arcuate area throughout the intermediate arcuate portion 52 is smaller than in the second contact-piece member 4, and an element corresponding to the projection 35 or 45 is not included.

The first, second and third contact-piece members 3, 4, 5 are simultaneously formed as punched out with the ends of the terminal portions 33, 43, 53 connected to one another with a tie bar 6. Thus, the members 3, 4, 5 in a unitary structure are assembled with the main body 1. More specifically, two units of the first, second and third contact-piece members 3, 4, 5 made in a unitary structure by the tie bar 6, are symmetrically disposed in the body member 1A with a predetermined distance provided therebetween in the transverse direction X. The tips of pushing means are inserted between the contact-piece units and applied to the stepped engagement portions 38, 48, 58. In the state mentioned above, one contact-piece unit is inserted inside of the body member 1A and further inserted into the contact piece holding portion 1B. As shown in FIG. 8, when the front wall 11 is provided in the through-hole **19*b* with a concave recess 27 having an inclined surface 27*a*, this shortens the time during which the pawl 47 passes through the through-hole 19*b*. This advantageously prevents the pawl 47** from being deformed.

With reference to FIG. 7, the following description will discuss in detail the structure in which the contact-piece members 3, 4, 5 are being assembled. The description will be made relative to the first contact-piece member 3 of one contact-piece unit as an example.

The contact-piece portion 31 is inserted and passed through the corresponding through-hole **19*a* in the body member 1A, and then fitted into the contact piece engagement groove 16*a* in the contact piece holding portion 1B. The projecting piece 34 is fitted in and held by the concave hole 16*a*'. The stepped engagement portion 38 comes in contact with the inner surface of the front wall 11 and the pawl 37 is engaged with the outer surface of the front wall 11, so that the front wall 11 is securely held by and between the stepped engagement portion 38 and the pawl 37. The intermediate arcuate portion 32 is disposed inside of the lateral side walls 14 in the body member 1A. The terminal portion 33 is fitted in the notch-like groove 22 formed between the lateral side wall 14 and the bottom wall portion 13. The projection 35 is fitted in the lower engagement groove 23*a* and inserted thereinto in the forward direction. The vertical movements of the projection 35 are regulated by upper and lower stepped portions s1, s2 of the engagement groove 23*a*, and the forward movement of the projection 35 is regulated by a front-end stepped portion s3 of the engagement groove 23*a*. At this time, provision may be made such that the projection 35 is pressingly inserted into the engagement groove 23*a***.

In the first contact-piece member 3 thus assembled, the base end part of the contact-piece portion 31 is inserted into the through-hole **19*a* in the body member 1A and the tip projecting piece 34 is fitted in and held by the concave hole 16*a*' in the contact piece holding portion 1B. This prevents the contact area 36 located between the projecting piece 34 and the base end part of the contact-piece portion 31 from being separated from the contact piece holding portion 1B. Even though a force in the front-to-back direction is applied to the first contact-piece member 3 during and after assembling, such a force is received because the stepped engagement portion 38 and the pawl 37 are engaged with the front wall 11. This substantially prevents the contact-piece portion 31 including the contact area 36 from being buckled. The entire intermediate arcuate portion 32 is located inside of the lateral side wall 14 of the body member 1A. Particularly, the lower end of the intermediate arcuate portion 32 is fitted in the notch-like groove 22 between the lateral side wall 14 and the bottom wall portion 13, so that both sides of the lower end of the intermediate arcuate portion 32 is supported. The arcuate area of the intermediate arcuate portion 32 is formed by punching and is not formed by bending. The vertical and forward movements of the terminal portion 33 are regulated by the engagement of the projection 35 with the engagement groove 23*a*. Thus, the intermediate arcuate portion 32** is so supported as to be hardly deformed.

The second contact-piece member 4 is assembled in a manner similar to the manner mentioned above. In the second contact-piece member 4, however, the projection 45 is inserted into the upper engagement groove **23*b* in the forward direction thereof. Likewise in the first contact-piece member 3, the contact-piece portion 41 of the second contact-piece member 4 is hardly separated and buckled. Further, the intermediate arcuate portion 42** is also hardly deformed.

In the third contact-piece member 5, the terminal portion 53 is fitted into the innermost part of the notch-like groove 22 and the forward movement of the terminal portion 53 is regulated by the innermost end s4 of the notch-like groove 22. The third contact-piece member 5 has no projection. This is because the intermediate arcuate portion 52 of the contactpiece member 5 is short and the portion 52 itself has a relatively great deformation-resisting strength.

FIG. 8 shows how the intermediate arcuate portion 42 of the contact-piece member 4 is disposed inside of the lateral side wall 14 of the body member 1A. The tie bar 6 is cut off after the contact-piece unit is assembled.

In the electrical connector thus assembled, the first contact-piece members 3 which are opposite to each other at both transverse sides of the contact piece holding portion 1B, are symmetrically disposed in a balanced manner. This also applies to the second contact-piece members 4 and the third contact-piece members 5. Such arrangement advantageously acts on high-speed transmission.

Figure 3:
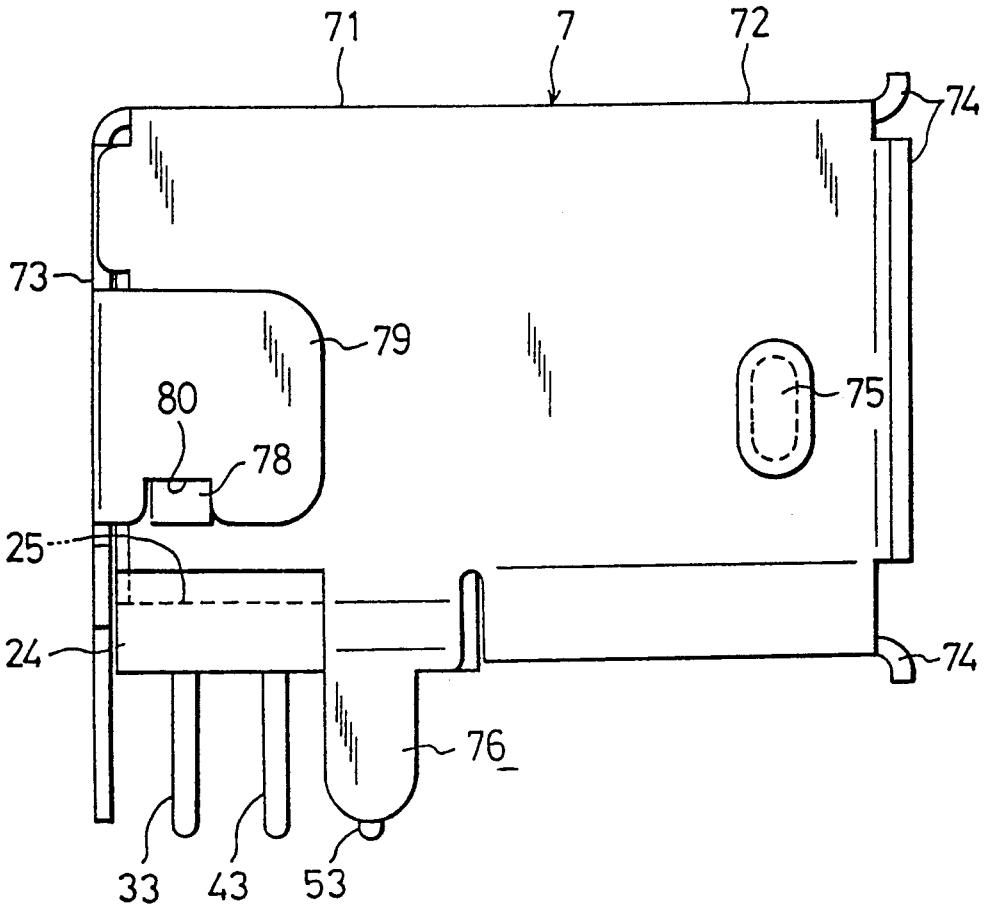
FIG. 3 is a side view of the electrical connector shown in FIG. 1.
Figure 5:
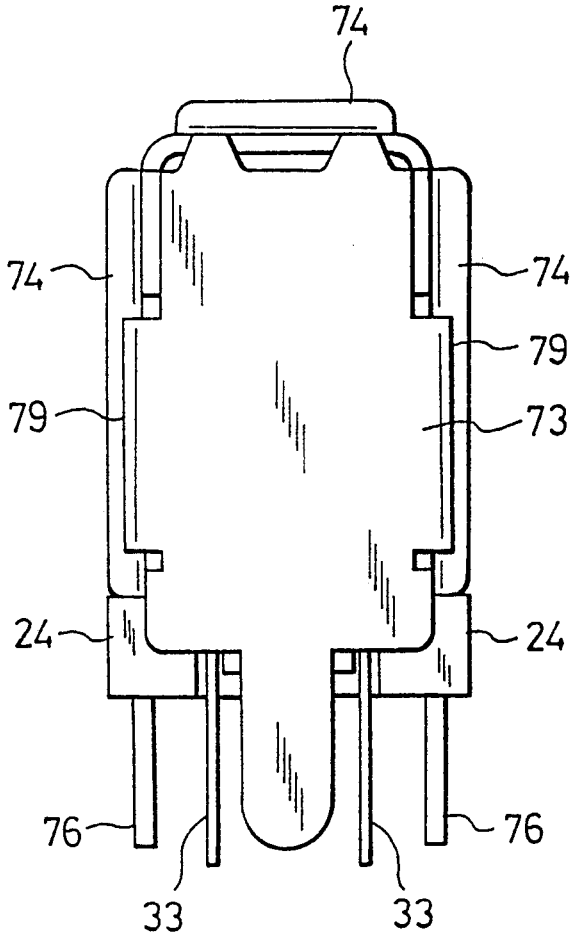
FIG. 5 is a rear view of the electrical connector shown in FIG. 1.

A shield frame 7 has, in a unitary structure, (i) a U-shaped portion 71 placed on the body member 1A, (ii) a casing portion 72 surrounding the contact piece holding portion 1B and (iii) a cover portion 73 covering the rear surface of the body member 1A. An outwardly extending guide piece 74 projects from the front end of the casing portion 72, and projecting portions 75 are formed at predetermined parts of the lateral sides of the casing portion 72. The U-shape portion 71 has a grounding terminal 76 and engagement pawls 77, 78. The U-shaped portion 71 is put on the body member 1A so that the casing portion 72 surrounds the contact piece holding portion 1B. Thereafter, the cover portion 73 is bent and overlaps the rear surface of the body member 1A as shown in FIGS. 3 to 5. Then, concave recesses 80 in engagement plates 79 of the cover portion 73 are engaged with the engagement pawls 77. The engagement pawls 77 are engaged with the engagement portions 26 of the body member 1A. The cover portion 73 may be formed separately from the U-shaped portion 71 and the casing portion 72.

Figure 6:
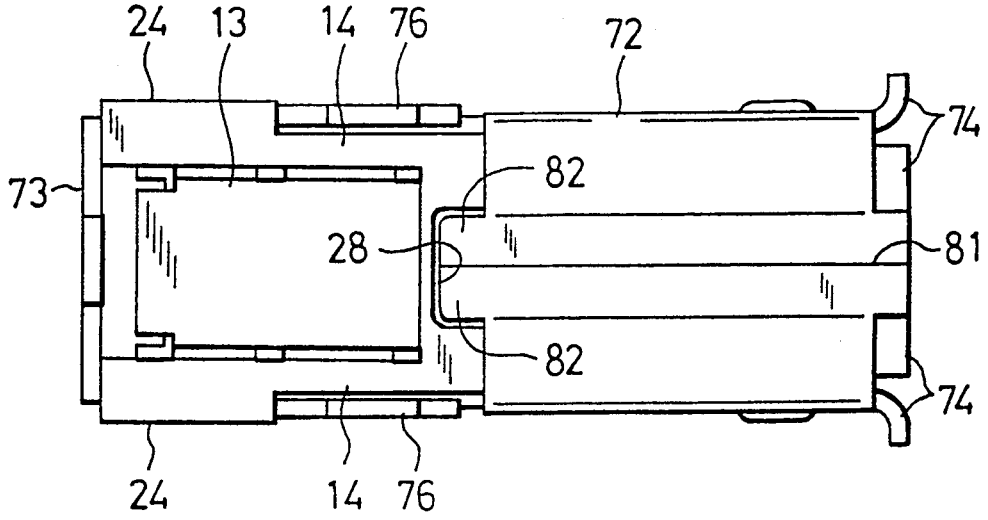
FIG. 6 is a bottom view of the electrical connector shown in FIG. 1
Figure 9:
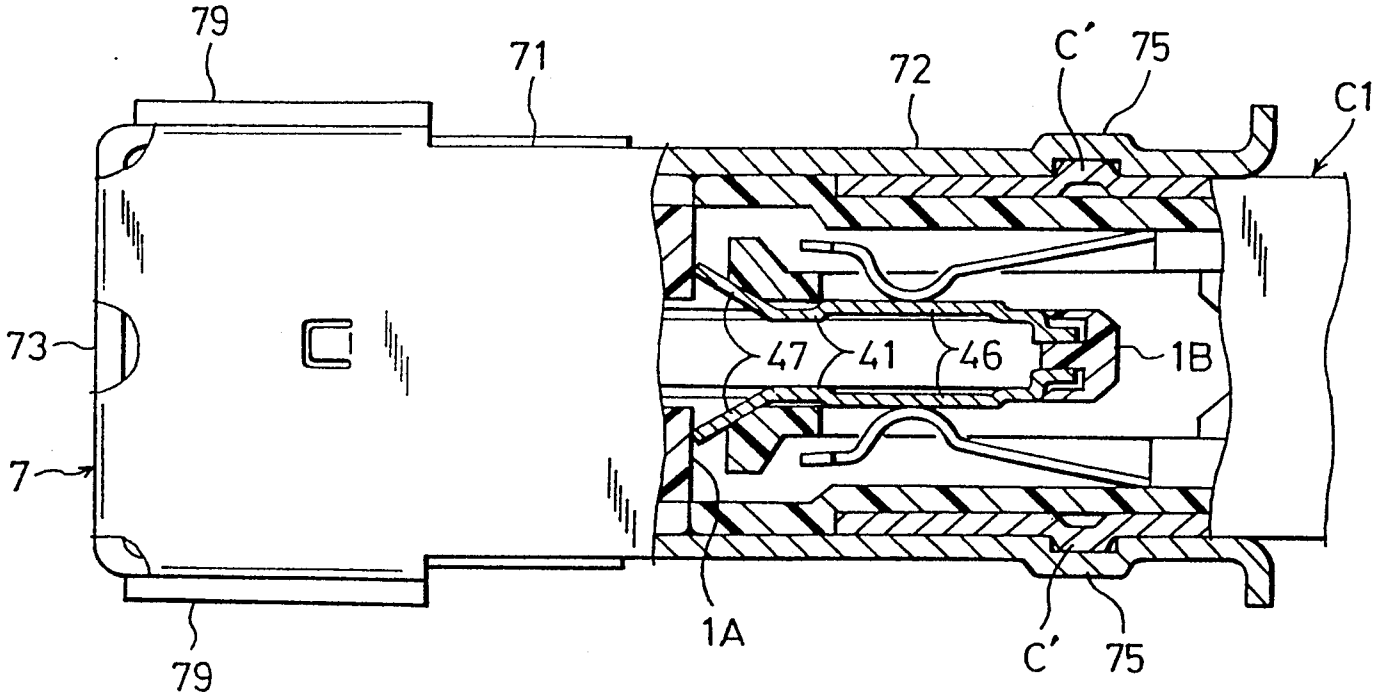
FIG. 9 is a plan view, with portions shown in transverse section, of the electrical connector of the present invention as connected to another electrical connector.
Figure 10:
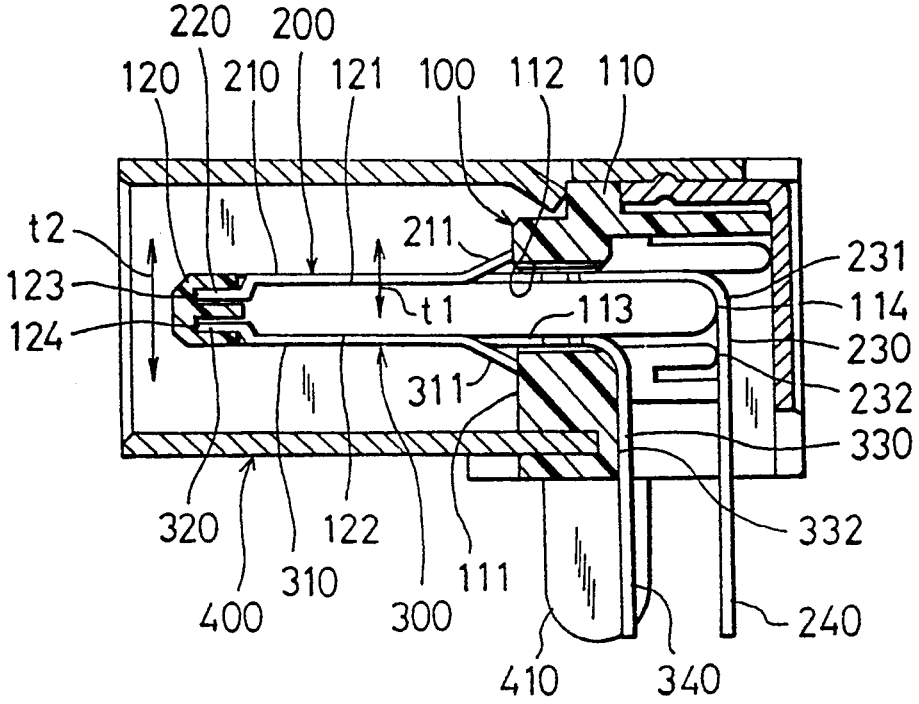
Fig.10 (Prior Art)
FIG. 10 is a vertical section view in side elevation of a conventional electrical connector.

As shown in FIG. 6, the casing portion 72 of the shield frame 7 is provided at the bottom thereof with abutting parts 81. Projecting pieces 82 project rearwardly from the rear ends of the abutting parts 81. These projecting pieces 82 are fitted into concave recesses 28 formed in the front end of the underside of the body member 1A with gaps provided between the projecting pieces 82 and the concave recesses 28. This enables the casing portion 72 to be deformed such that the abutting parts 81 are opened. Accordingly, when a counter electrical connector Cl is inserted into the casing portion 72 as shown in FIG. 9, the abutting parts 81 (See FIG. 6) can be naturally opened or separated from each other by the counter electrical connector C1. This restrains the casing portion 72 from being permanently deformed even though the counter electrical connector C1 is quite often inserted in and removed from the electrical connector of the present invention. This is also useful for maintaining, for a long period of time, a good feeling or click obtained at the time when projecting portions C' of the counter electrical connector C1 are fitted to or removed from the projecting portions 75. The guide piece 74 facilitates the insertion of the counter electrical connector C1 into the casing portion 72.

What is claimed is:

1. An electrical connector comprising:

a hollow body member having a front wall, a top wall, a bottom wall and lateral walls, the transverse width of said hollow body member being shorter than the vertical thickness thereof;

a contact piece holding portion projecting forwardly from said front wall of said body member, the transverse width of said contact piece holding portion being shorter than the vertical thickness thereof;

a plurality of contact piece engagement grooves formed in a plurality of parts in the thickness direction of the lateral sides of said contact piece holding portion;

a plurality of concave holes formed in said contact piece holding portion, said concave holes extending forwardly from the tips of said contact piece engagement grooves, respectively;

a plurality of through-holes formed in said front wall of said body member, said through-holes communicating with said contact piece engagement grooves;

a plurality of contact-piece members formed by punching to have, in a unitary structure, (i) contacts formed at predetermined positions thereof and adapted to be contacted with a counter electrical connector, (ii) contact-piece portions passed through said through-holes and engaged with said contact piece engagement grooves in said contact piece holding portion, (iii) projecting pieces which project from the front ends of said contact-piece portions and which are fitted in and held by said concave holes in said contact piece holding portion, (iv) intermediate arcuate portions rearwardly extending from said contact-piece portions and disposed inside of said body member, and (v) terminal portions extending from said intermediate arcuate portions;

stepped engagement portions formed by bending the boundary parts between said contact-piece portions and said intermediate arcuate portions, said stepped engagement portions coming in contact with the inner surface of said front wall of said body member; and pawls so formed at said contact-piece portions as to face said engagement portions, said pawls being engaged with the outer surface of said front wall of said body member.

2. An electrical connector according to claim 1, wherein:

the body member is provided in the bottom wall portion thereof with notch-like grooves formed throughout the thickness of said bottom wall portion, said notch-like grooves extending forwardly from the rear end of said body member;

engagement grooves formed in a plurality of parts in the thickness direction of the wall surfaces of said notch-like grooves, said engagement grooves extending forwardly from the rear end of said body member;

the terminal portions extend from the intermediate arcuate portions of the contact-piece members, said intermediate arcuate portions having arcuate areas which are formed by punching; and said terminal portions have projections which are inserted into said engagement grooves in the forward direction thereof such that the vertical movements of said projections are regulated by the upper and lower stepped parts of said engagement grooves and that the forward movement of said projections is regulated by stepped parts at the front ends of said engagement 3. An electrical connector according to claim 2, further comprising:

a shield frame having a U-shaped portion, a casing portion and a cover portion, said casing portion and said cover portion being disposed at both sides of said U-shaped portion, wherein:

said U-shaped portion being placed on the body member;

said casing portion surrounding the contact piece holding portion; and said cover portion overlapping the rear surface of said body member to close said rear surface.

4. An electrical connector according to claim 3, wherein:

the shield frame is provided at the bottom of the casing portion thereof with abutting parts; and projecting pieces project rearwardly from the rear ends of said abutting parts and are fitted into concave recesses formed in the front end of the underside of the body member with gaps provided between said projecting pieces and said concave recesses.

5. An electrical connector according to claim 1, further comprising:

a shield frame having a U-shaped portion, a casing portion and a cover portion, said casing portion and said cover portion being disposed at both sides of said U-shaped portion, wherein:

said U-shaped portion being placed on the body member;

said casing portion surrounding the contact piece holding portion; and said cover portion overlapping the rear surface of said body member to close said rear surface.

6. An electrical connector according to claim 5, wherein:

the shield frame is provided at the bottom of the casing portion thereof with abutting parts; and projecting pieces project rearwardly from the rear ends of said abutting parts and are fitted into concave recesses formed in the front end of the underside of the body member with gaps provided between said projecting pieces and said concave recesses.

* * * * *

UNITED STATES PATENT AND TRADEMARK OFFICE

CERTIFICATE OF CORRECTION

PATENT NO. : 5,266,038

DATED : November 30, 1993

INVENTOR(S) : Masahiko Nakamura

It is certified that error appears in the above-identified patent and that said Letters Patent is hereby corrected as shown below:

Claim 2, column 10, line 34, "grooves." should be inserted after "engagement".

Signed and Sealed this

Third Day of May, 1994

Bruce Lehman

*Attest:*

BRUCE LEHMAN

*Attesting Officer*

*Commissioner of Patents and Trademarks*